US005957308A

United States Patent [19]

Zierenberg

[11] Patent Number: 5,957,308

[45] Date of Patent: Sep. 28, 1999

[54] PISTOL HANGING SYSTEM FOR GUN SAFES

[76] Inventor: Terry Reid Zierenberg, 790 N. 400 East, Mapleton, Utah 84664

[21] Appl. No.: 08/980,672

[22] Filed: Dec. 1, 1997

[51] Int. Cl.[6] ..... A47F 7/00

[52] U.S. Cl. ..... 211/64; 211/119.004; 211/118; 211/86.01

[58] Field of Search ..... 211/113, 117, 211/118, 87.01, 86.01, 64, 34, 35, 85.29, 85.7, 119.004

[56] References Cited

U.S. PATENT DOCUMENTS

| | | | |
|---|---|---|---|
| 1,447,636 | 3/1923 | White | 211/35 X |
| 2,359,372 | 10/1944 | Leader | 211/35 X |
| 2,866,559 | 12/1958 | Byrne | 211/35 |
| 3,063,570 | 11/1962 | Kroner | 211/113 |
| 4,327,836 | 5/1982 | Okuno | 211/113 X |
| 4,796,762 | 1/1989 | Law | 211/117 X |
| 5,259,497 | 11/1993 | Brothers et al. | 211/13.1 X |
| 5,671,849 | 9/1997 | Bacon | 211/87.01 X |

*Primary Examiner*—Robert W. Gibson, Jr.
*Attorney, Agent, or Firm*—Mallinckrodt & Mallinckrodt

[57] ABSTRACT

A pistol hanging system for gun safes is disclosed including a retrofitable rack for attachment to the interior door panel of a gun safe, removably attached fabric holsters for supporting and organizing hand guns and other valuables. Means of attachment includes a cooperating hook and loop engaging system that allows for repositioning without damage to the safe or rack.

14 Claims, 3 Drawing Sheets

PISTOL HANGING SYSTEM FOR GUN SAFES

BACKGROUND OF THE INVENTION

The present invention relates to a system for hanging pistols on the interior surfaces of gun safes, and in particular, the inside surface of the door, allowing for infinite arrangements as gun collections change in size and variety.

The use of gun safes has become increasingly widespread due to the increase in property crimes, and the desire of law abiding citizens to secure possessions such as weapons and other valuables against damage, theft, vandalism and improper use or possession. Safes are also an important tool for organizing and storing these valuables. Typically a safe includes a fixed or a fixable safe body having an opening to receive a door therein. The door is attached to the safe body by one or more hinges so that the door may selectively secure the opening or allow access to the interior by an authorized user.

The door is typically provided with a fabric, carpet, or vinyl covered steel back panel that conceals the safe's locking mechanism. Also, the interior of the safe body is typically lined with a similar fabric, carpet, or vinyl covering on the side-walls, back-walls, floor, and shelves. The configurations for the shelves can be as simple as one horizontal board supported at both ends by vertically adjustable clips, to a series of shelves, dividers, and racks capable of holding in excess of 30 rifles plus cameras, coins, jewelry, etc.

While shelves are fine for storing and organizing books, they usually prove inadequate for pistol storage. As it is the nature of man to fill any horizontal surface with clutter, there is needed a simple, efficient and cost effective system for organizing and storing handguns utilizing the vertical surfaces of the safe. Such a system would allow easy access and visibility while providing flexibility of arrangement and ease of attachment.

Attempts have been made to organize and store guns on the interior panel of the door by attaching wooden or plastic pegs to the steel panel with self tapping sheet metal screws. The pistols are then hung by their respective trigger guards. While this is cost effective, it does require specific tools and does not allow for subsequent rearrangements without leaving unsightly evidence of prior location.

FIG. 1. depicts a partial cross section of the door plate, frame, and interior door panel with a plastic or wooden peg attached, depicted generally at 6, made in accordance with the prior art. The door plate 8 and frame 10 are permanently welded along the perimeter of the frame. The removable steel door panel 12 is covered 14 with vinyl, fabric, or carpet and is attached with hooks 16 or screws with caps 18 or both. The wooden or plastic peg 20 is secured with a self tapping screw 22 that is typically hidden with a plug 24 or cap.

FIG. 2. depicts an upper corner of the door, depicted generally at 110, made in accordance with the prior art. Shown is the door plate 112, frame 114, steel door panel 116 with a pistol 118 hanging on a peg 120.

It is clear, in the prior art of FIG. 1, that the self tapping screw 22 penetrates both the cover 14 and the steel door panel 12. If the peg is relocated an unsightly hole is left behind. The issue of relocation is important since guns are bought and sold and collections change in size and variety. Also, with vertically adjustable interior shelves it is possible to reconfigure the interior structure to accommodate a large variety of valuables, a desirable feature. However, in an effort to maximize shelf size, safe manufacturers have left little clearance between the front edge of the shelf and the door panel 12 when the door is closed. Typically the clearance is ¾" or less, considerably less than is needed for a pistol to clear without interference. Therefore, every time a shelf is moved up or down it is possible that one or more pistols will have to be relocated with their accompanying peg, thus leaving a scar. Clearly, a better, less destructive, more flexible system is needed.

OBJECTS AND SUMMARY OF THE INVENTION

It is an object of the invention to provide a hanging system for organizing and storing pistols and other valuables that will make use of the vertical interior surfaces of gun safes.

It is another object of the present invention to provide a retrofitable system for such organizing and storing, for safes manufactured prior to this invention.

It is another object of the present invention to provide a means of attachment that will require no tools and not mar or degrade the safes to which it is to be attached.

The above and other objects of the invention are realized in specific illustrated embodiments of a pistol hanging system in which the posterior surface of a fabric holster is backed with the hook component of a hook and loop system (such as Velcro) and the vertical surface it is to be attached to is covered with the loop component of a hook and loop system (such as Velcro).

BRIEF DESCRIPTION OF THE DRAWINGS

The above and other objects, features, and advantages of the invention will become apparent from a consideration of the following detailed description presented in connection with the accompanying drawings in which.

DETAILED DESCRIPTION

Figure 1:
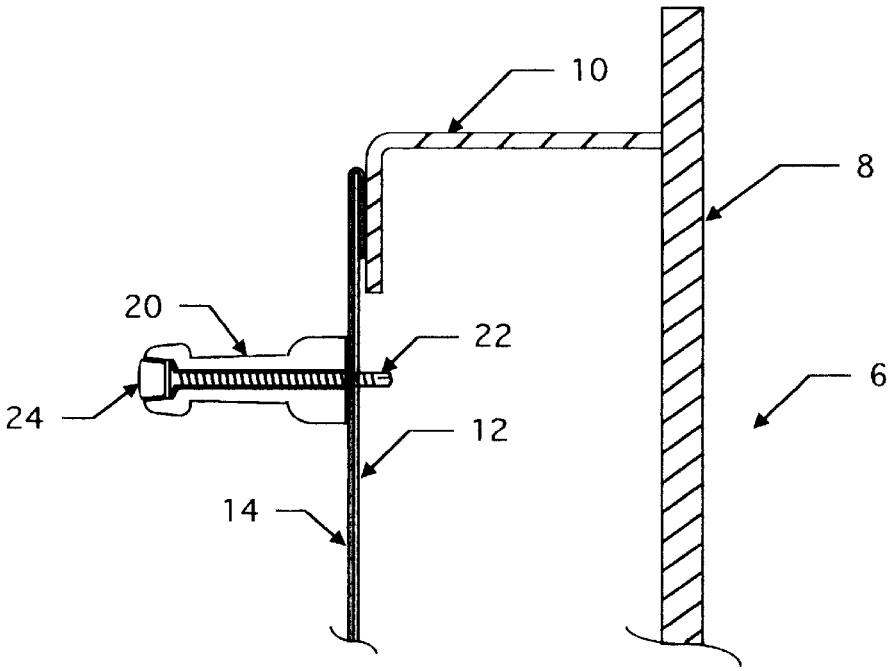
FIG. 1 PRIOR ART
FIG. 1 shows a partial, cross-sectional view of a safe door having a peg hanging system made in accordance with the teachings of the prior art.
Figure 2:
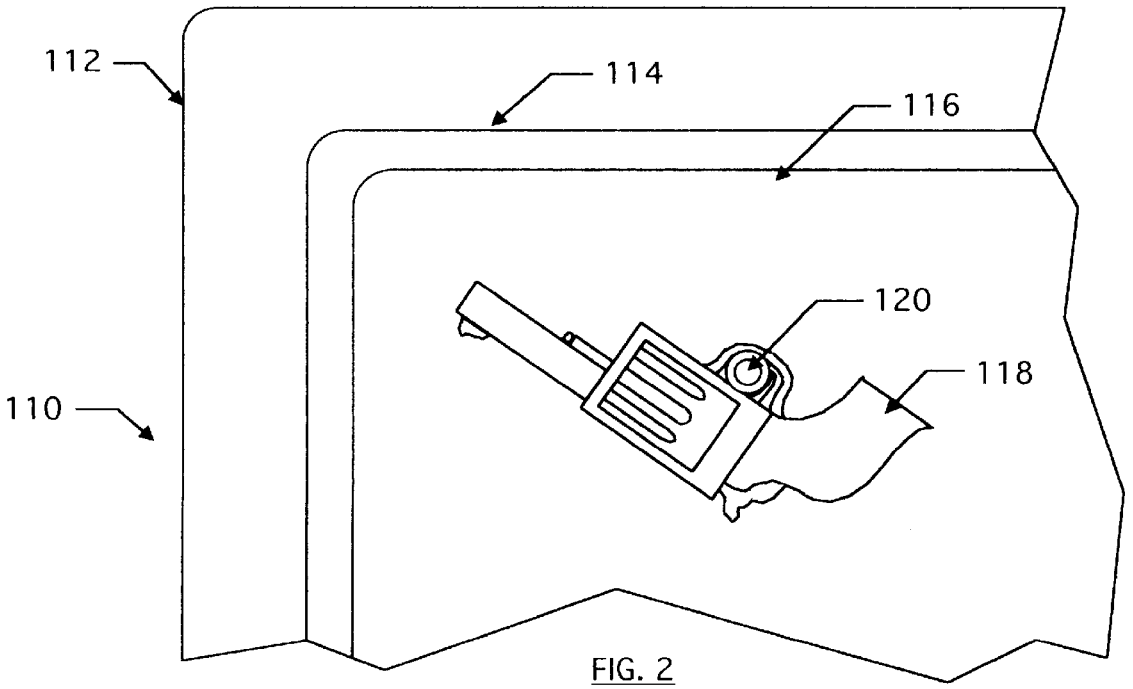
FIG. 2 PRIOR ART
FIG. 2 shows a partial, frontal view of a safe door having a peg hanging system made in accordance with the principles of the prior art.
Figure 3:
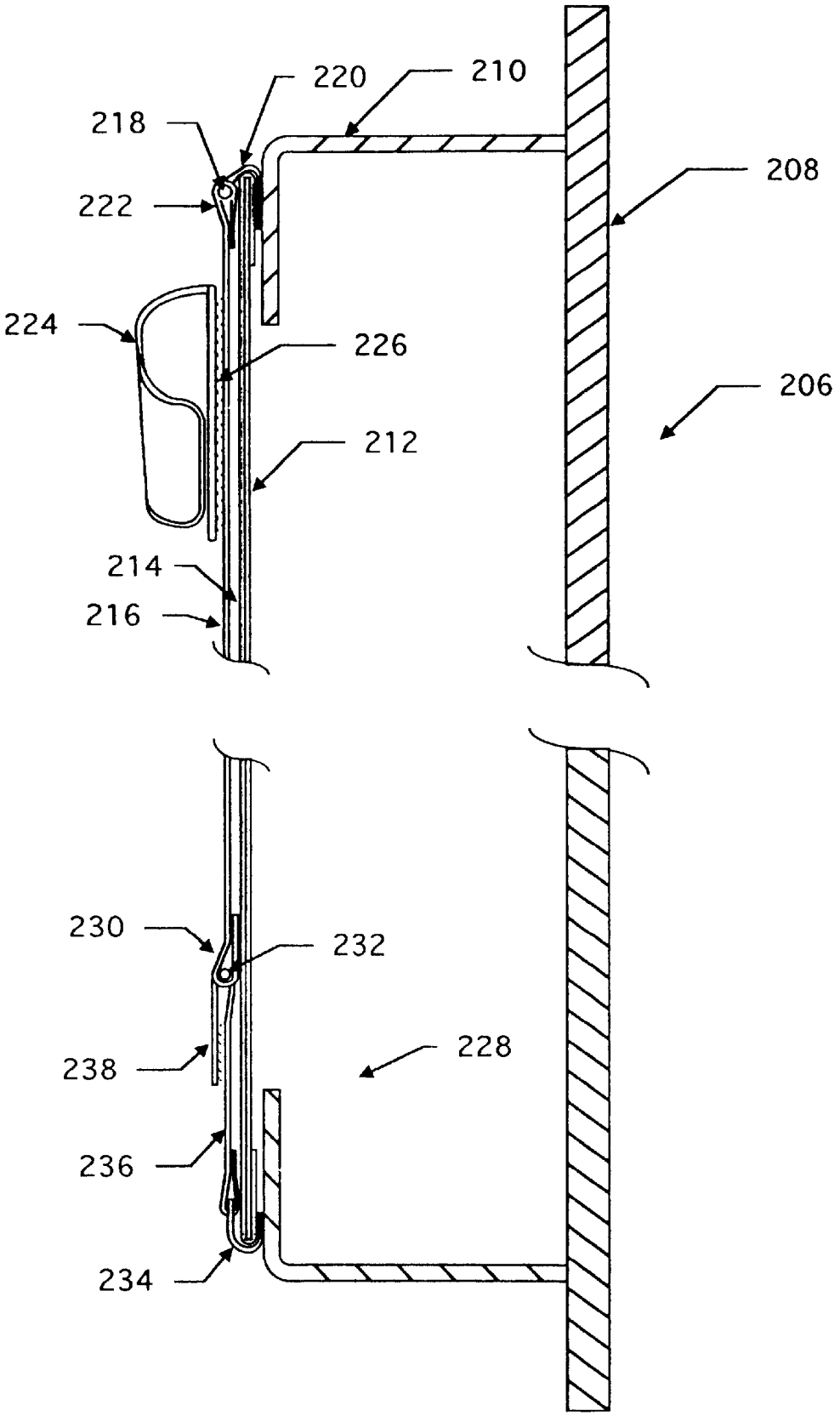
FIG. 3 shows a partial, cross-sectional view of a safe door having a retrofitable hook and loop pistol hanging system made in accordance with the teachings of the present invention.

Reference will now be made to the drawings in which the various elements of the present invention will be given numeral designations and in which the invention will be discussed so as to enable one skilled in the art to make and use the invention. Referring to FIG. 3, there is shown a safe door depicted generally at 206. The door plate 208 is permanently joined by welding to the frame 210 and the interior door panel 212 is removably attached to the frame at it's corners. The interior door panel has a vinyl covering 214. Attached at the top with two formed steel hooks 220 is the loop component 216 of the system. Sewn into the top edge of the loop component is a hem 222 of sufficient size as to accommodate a 3/16" to ¼" round steel rod 218 to which the hooks 220 are attached. How this is accomplished will be readily understood by referring to FIG. 4. Also shown in FIG. 3 is a removable fabric holster 224 with the hook component 226 sewn on the posterior surface securing it to the loop component 216.

The lower portion of FIG. 3, depicts generally at 228, one possible system for tensioning the loop component 216, known herein after as the rack 216. Sewn into the bottom edge of the rack 216 is a hem 230 of sufficient size as to accommodate a 3/16" to 1/4" round steel rod 232. A strap comprised of loop material 236 on one end and hook material 238 on the other end is attached to a metal truss catch 234. The truss catch 234 is slipped between the door panel 212 and the frame 210. The opposite end 238 of the strap is looped over the round steel rod 232 and stuck to the loop portion 236 of the strap.

Figure 4:
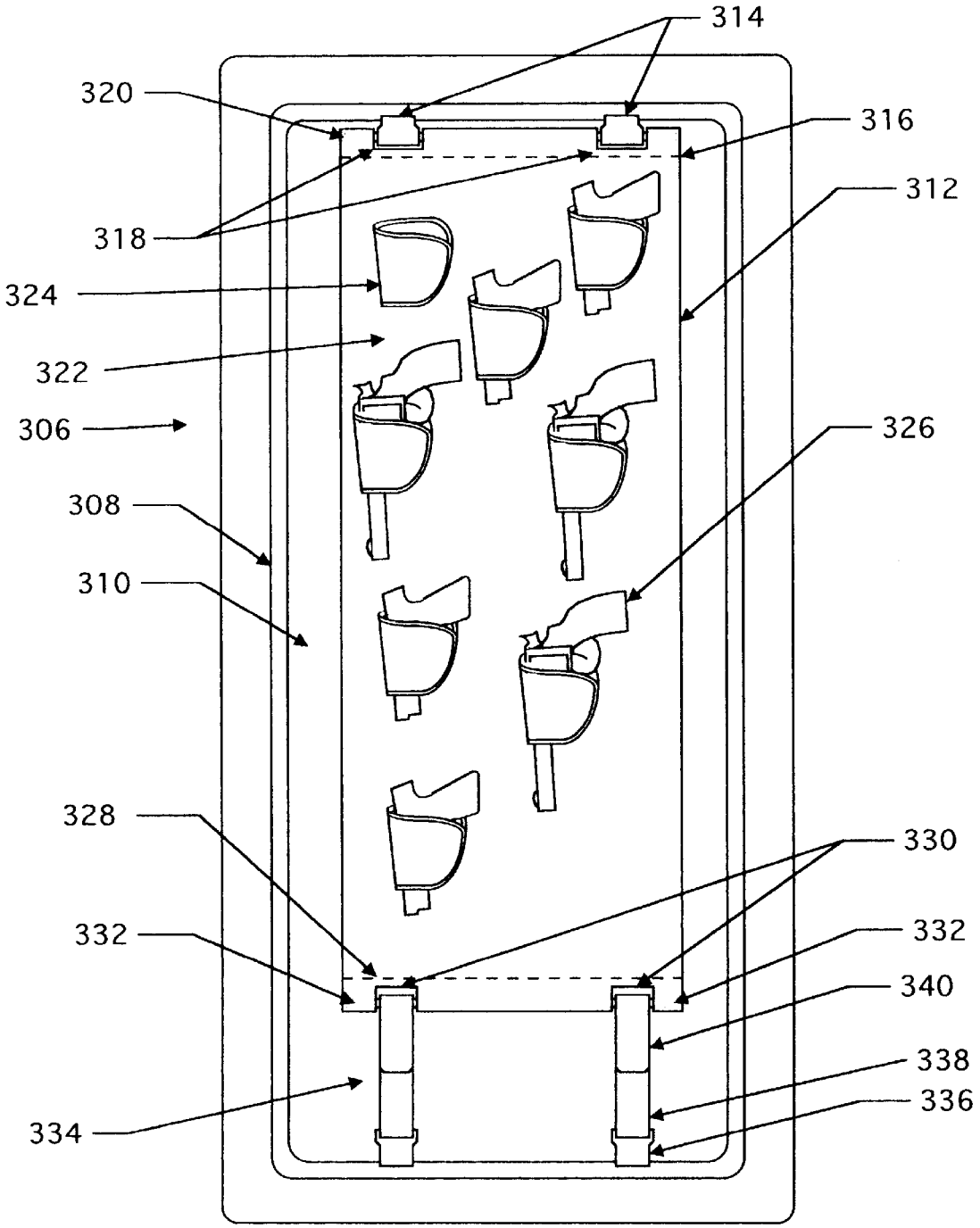
FIG. 4 shows a full frontal view of a safe door having a retrofitable hook and loop pistol hanging system.

Referring now to FIG. 4 there is shown the interior side of a safe door depicted generally at 306. The door has a frame 308 and a vinyl covered door panel 310. Over the top edge of the door panel 310 the rack 312 has been hung by two steel hooks 314. Into the upper edge of the rack 312 has been sewn a hem 316 into which two notches have been cut 318. A round steel rod 320 has been inserted into the hem 316 and threaded through the steel hooks 314. Thus is the upper end supported. Also shown generally at 322 are a number of holsters 324 that have had the hook component of velcro sewn onto their posterior sides. The holsters 324 have been stuck randomly to the rack 312 to illustrate normal usage. Into the holsters, pistols 326 have been placed, also to illustrate normal usage.

The rack 312 also includes a hem 328 sewn along the bottom edge which has been notched 330. Into the hem 328 a round steel rod 332 has been inserted. A strap, depicted generally at 334 consisting of a truss catch 336 on the lower end and a length of loop component material 338 with a two inch tab of hook component material 340 sewn onto the other end, is threaded through the notch 330 and over the rod 332, pulled down tight and stuck to itself.

Thus it can be readily appreciated that this system can be attached to any safe without the use of tools and without causing damage to the safe. It can also be readily appreciated by one skilled in the art that this system is not limited to hand guns, but a multiplicity of valuables could be accommodated by simply substituting a pouch or envelope for the holster. Those skilled in the art will recognize numerous modifications which may be made without departing from the scope and spirit of the invention. The appended claims are intended to cover such modifications.

What is claimed is:

1. A pistol hanging system for gun safes, comprising:

a sheet of flexible material, including a loop component of a hook and loop fastening system extending over at least a portion of said sheet;

attachment means for attaching the sheet of flexible material to the interior door panel of a gun safe;

at least one pistol holster; and a hook component of the hook and loop fastening system secured to the at least one pistol holster for removably attaching the pistol holster to the loop component of the hook and loop fastening system.

2. A pistol hanging system for gun safes according to claim 1, wherein the attachment means attaches the sheet of flexible material to the interior door panel of the gun safe in a vertical orientation.

3. A pistol hanging system for gun safes according to claim 2, wherein the sheet has an upper edge and wherein the attachment means includes an upper transversely disposed hem along the upper edge; an upper rod disposed in the upper hem; and at least one hook secured to the door panel to receive and hold the upper rod, thereby securing the sheet to hang downwardly from the upper rod.

4. A pistol hanging system for gun safes according to claim 3, wherein the upper hem has at least one opening therein through which the upper rod extends and through which an at least one hook can receive and hold the upper rod.

5. A pistol hanging system for gun safes according to claim 3, wherein the sheet has a lower edge and wherein the attachment means includes a lower transversely disposed hem along the lower edge; a lower rod disposed in the lower hem; and tension means secured to the door panel to receive and hold the lower rod and tension the sheet as held between the upper rod and lower rod.

6. A pistol hanging system for gun safes according to claim 5, wherein the lower hem has at least one opening therein through which the lower rod extends and through which tension means can receive and hold the lower rod.

7. A pistol hanging system for gun safes according to claim 6, wherein the tension means includes at least one tensioning strap secured to the door panel and to the lower rod.

8. A pistol hanging system for gun safes according to claim 5, wherein the door panel has a bottom edge and wherein the at least one tensioning strap is secured to the door panel by at least one truss catch engaging the bottom edge.

9. A pistol hanging system for gun safes according to claim 1, wherein the sheet of flexible material has a top and bottom, and wherein the attachment means includes means for attaching the top of the sheet and means for attaching the bottom of the sheet to the interior door panel.

10. A pistol hanging system for gun safes according to claim 9, wherein the attachment means includes tension means for tensioning the sheet between the means for attaching the top of the sheet and the means for attaching the bottom of the sheet.

11. A pistol hanging system for gun safes according to claim 10, wherein the tension means is included as a part of the means for attaching the bottom of the sheet to the door panel.

12. A pistol hanging system for gun safes according to claim 1, wherein the pistol holster includes a sheet of fabric having an exterior layer of durable material bonded to an interior liner of softer durable material, means securing said material together along a portion of respective edges thereof to hold said material in folded over, pistol receiving configuration, and wherein the hook component of the hook and loop fastening system is secured to the exterior layer of material and is of a size sufficient to securely hold the pistol holster to the loop component of the hook and loop fastening system.

13. A pistol hanging system for gun safes having a safe door with an interior side of the door, comprising:

an interior door panel, including a loop component of a hook and loop fastening system extending over at least a portion of said panel;

attachment means for attaching the interior door panel to the interior side of the door of the gun safe with the loop component of the hook and loop fastening system exposed to a user of the safe when the door is open;

at least one pistol holster; and a hook component of the hook and loop fastening system secured to the at least one pistol holster for removably attaching the pistol holster to the loop component of the hook and loop fastening system.

14. A pistol hanging system for gun safes according to claim 13, wherein the interior door panel includes a sheet of substantially rigid material and a sheet of flexible material attached to the substantially rigid material, the loop component of the hook and loop fastening system extending over at least an exposed portion of the flexible material.

* * * * *